United States Patent [19]

Norton et al.

[11] 4,451,996

[45] Jun. 5, 1984

[54] ATHLETIC SHOE WITH COLLAR

[75] Inventors: Edward J. Norton, Kingston; Paul Oparowski, Derry; Alphonse L. Belavitch, Salem, all of N.H.

[73] Assignee: New Balance Athletic Shoe, Inc., Boston, Mass.

[21] Appl. No.: 360,663

[22] Filed: Mar. 22, 1982

[51] Int. Cl.[3] ..... A43B 5/00; A43B 19/00

[52] U.S. Cl. ..... 36/129; 36/71

[58] Field of Search ..... 36/129, 71, 68, 69, 36/114, 89, 90, 117, 118, 119, 120, 121

[56] References Cited

U.S. PATENT DOCUMENTS

| | | | |
|---|---|---|---|
| 387,119 | 7/1888 | Stevens . | |
| 487,492 | 12/1892 | Pugsley . | |
| 746,338 | 12/1903 | Keen . | |
| 1,472,415 | 10/1923 | Haggerty . | |
| 1,610,700 | 12/1926 | Morton . | |
| 2,302,694 | 4/1942 | Jennings . | |
| 2,444,428 | 7/1948 | Carrier . | |
| 2,918,734 | 12/1959 | Hyde . | |
| 2,942,359 | 6/1960 | Bushway . | |
| 2,972,822 | 2/1961 | Tanner . | |
| 3,237,319 | 3/1966 | Hanson . | |
| 3,537,716 | 11/1970 | Norgiel . | |
| 3,659,361 | 5/1972 | White . | |
| 4,316,335 | 2/1982 | Giese et al. | 36/129 |

*Primary Examiner*—Patrick D. Lawsor

*Attorney, Agent, or Firm*—Pennie & Edmonds

[57] ABSTRACT

An athletic shoe includes an outsole assembly and a shoe upper whose quarter sections extend above the ankles. A cut out area extends over one ankle, around the heel and over the ankle within the quarter sections, and a collar closes the cut out area. The collar includes a high density foam lamina to support and protect the ankles, and, because of its pliability, potential pressure points exerted on the foot with accompanying irritation are substantially eliminated.

9 Claims, 8 Drawing Figures

ATHLETIC SHOE WITH COLLAR

DESCRIPTION

1. Technical Field

The present invention relates to an athletic shoe, particularly an athletic shoe with quarter sections including a collar covering the ankle bone on both the lateral and medial sides of the athletic shoe, and extending around the rear of the quarter sections above the counter for support and protection of the ankle bones.

2. Background Art

The prior art is replete with disclosures of athletic shoes which include structure either within or supported by the athletic shoe for supporting the foot. Typically, the structure may embrace support and protect the ankle bone on both the lateral and medial sides of the foot. Representative of prior art disclosures of athletic shoes are U.S. Pat. Nos. 1,610,700 to D. J. Morton; 2,942,359 to G. F. Bushway et al.; 3,237,319 to A. W. Hanson; 3,535,800 to R. Stohr; 3,537,716 to L. I. Norgiel; 3,659,361 to T. P. White, Sr.; and 4,222,183 to B. J. Haddox.

Turning to the prior art, and particularly to prior art disclosures of athletic shoes of the type to be described herein, the Morton patent discloses a gusset which extends to the regions of the ankle bone on both sides of the foot from the rear, or heel, and which is capable of expanding with foot movement to permit the leg embracing portion of the athletic shoe more readily to conform to the foot. Bushway et al. disclose the use of a support member in an athletic shoe which is engaged about the heel and ankles of the wearer for purposes of conforming portions of the athletic shoe to the contours of the foot as may be engaged thereby to provide a firm support for the foot, and at the same time to eliminate chafing or irritation of the heel and ankle portions.

The other prior art patents disclose other forms of athletic shoes, such as a ski boot, an ice skate and a wrestling shoe. Of these prior art patents, both Hanson and Norgiel describe a support received within a ski boot. In the former patent the support is disclosed as disposed in juxtaposition with the ankles and the heel of the foot; while in the latter patent the support is disclosed as juxtaposed to the ankles of the foot. The Stohr patent, also disclosing a ski boot, describes a pleated, accordian-like type insert within the region of the heel portion of the foot and a similar insert within the region of the closure flap at the instep of the foot. The White, Sr., patent describes an ice skate including a pair of cutout regions in the boot over the ankle bones on both the medial and lateral sides of the foot and circular cup members secured around each opening to protect the ankle bone. Finally, the Haddox patent discloses an athletic shoe, such as a wrestling shoe including a reinforcing support both within the region of the ankles on both the medial and lateral sides of the foot and within the region of the rear of the shoe. The athletic shoe, otherwise, is comprised of a reinforced ventilating material.

3. Summary of the Invention

The invention is directed to an athletic shoe which is an improvement over prior art athletic shoes of the type disclosed by both Morton and Bushway et al. Particularly, the athletic shoe comprises a sole assembly and an upper including at least instep and quarter sections that extend above the region of the ankles of the foot. The aforementioned sections, and the other sections of the upper including a counter and toe section, are connected to the sole assembly. An area within the region of each ankle bone and extending around the heel, over the Achilles tendon, is cut out from the quarter sections. A collar of cushioning material closes the cutout area to embrace, support and protect the ankles, as well as to provide a measure of pliability greater than that of surrounding portions of the upper to substantially eliminate any potential pressure points within the cutout area.

Other aspects and features of the improved athletic shoe will become clear as the description, to be read in conjunction with the drawing figures, continues.

BEST MODE FOR CARRYING OUT THE INVENTION

Figure 1:
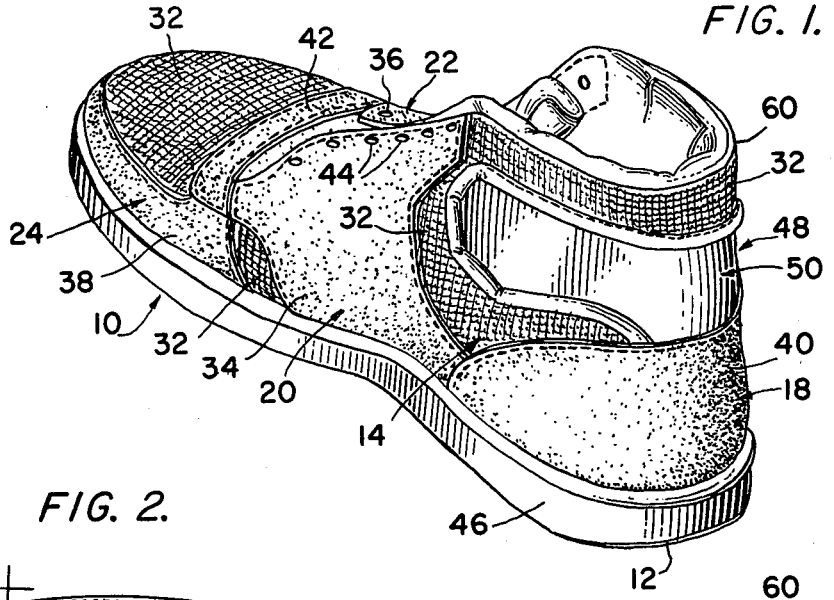
FIG. 1 is a view in rear perspective of the athletic shoe and collar including a breakaway portion within the region of the collar.
Figure 2:
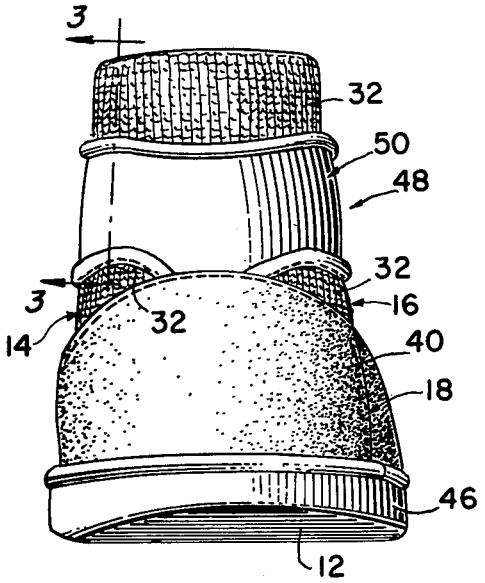
FIG. 2 is a view in elevation of the rear of the athletic shoe.
Figure 3:
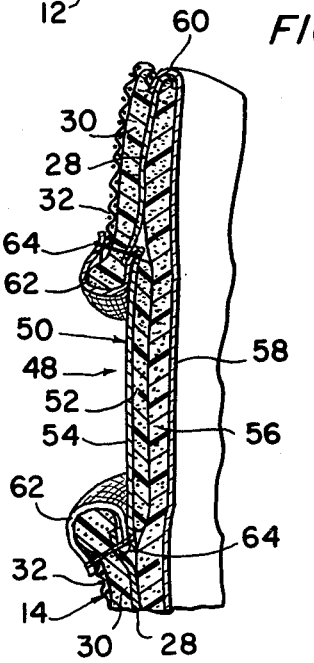
FIG. 3 is a view in section as seen along the line 3—3 in FIG. 2.

Referring first to FIGS. 1–5, the athletic shoe 10 of the invention comprises a sole assembly and a shoe upper of the so-called "high-top" variety. The sole assembly is conventional and generally may include an insole, a midsole (neither of which are shown) and an outsole 12. The shoe upper, on the other hand, is of improved construction including generally a pair of quarter sections 14, 16, a counter 18 surrounding the rear portions of the quarter sections toward the sole assembly, a pair of instep sections 20, 22 surrounding the forward portions of the quarter sections and the lower portions toward the sole assembly, a toe section 24 and a tongue 26.

The shoe upper (FIG. 3) comprises a mesh lamina 28, a lamina 30 of a foam material, and a fabric lamina 32 which may be of canvas or a canvas-like material. As may be seen in the figures, and perhaps best seen in FIG. 3, the mesh lamina is visible from the exterior of the athletic shoe, while the foam material lamina is confined between that lamina and the fabric lamina toward the interior of the athletic shoe. A leather or leather-like material having a suede or simulated suede finish provides a surface covering over portions of the shoe upper. The surface covering includes portions 34, 36 overlying the instep sections 20, 22, respectively, a portion 38 around the toe section 24, and a portion 40 over the counter 18. The surface covering also includes a portion 42 around the upper instep of the foot connecting with portion 38 on both the lateral and medial sides of the foot.

The instep sections 20, 22 (and portions 34, 36) are stitched to quarter sections 14, 16, counter 18 (and portion 40) and toe section 24 (and portions 38, 42); while the quarter sections are stitched to counter 18 (and portion 40). The stitching operation may be carried out in any conventional manner.

Each instep section 20, 22 and overlying portions 34, 36 includes eyelets 44 arranged along the facing edges in a sufficient number of eyelets to enable the athletic shoe to be laced snugly over the instep of the foot. Tongue 26 formed primarily of a cushioning material (not shown) throughout its inner surface, below a vinyl sheet material layer, is received below the laces (not shown) to cushion the instep region when the athletic shoe is secured to the foot.

A foxing strip 46 surrounds the sole assembly and shoe upper as is customary in shoes of this type.

A cutout 48 (see FIGS. 1–3) is provided in the quarter sections 14, 16. The cutout extends from within the area over and around the ankle bones on the lateral and medial sides of the foot and around the rear of the foot over the Achilles tendon. An insert 50 closes the cutout and, as will be discussed, provides embracing support and protection for the ankle bones, as well as the heel in the region of the Achilles tendon.

Figure 4:
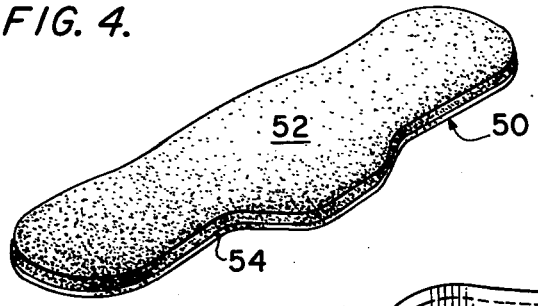
FIG. 4 is a view in perspective of the reverse side of the collar.
Figure 5:
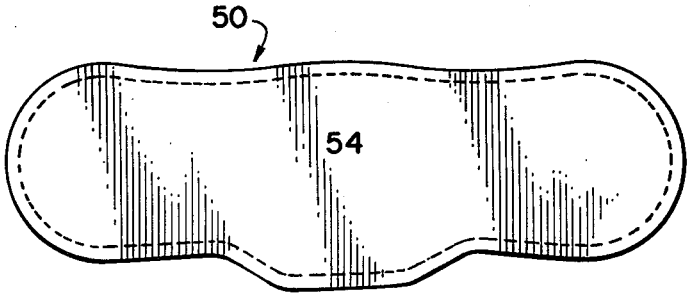
FIG. 5 is a view in elevation of the obverse side of the collar.
Figure 6:
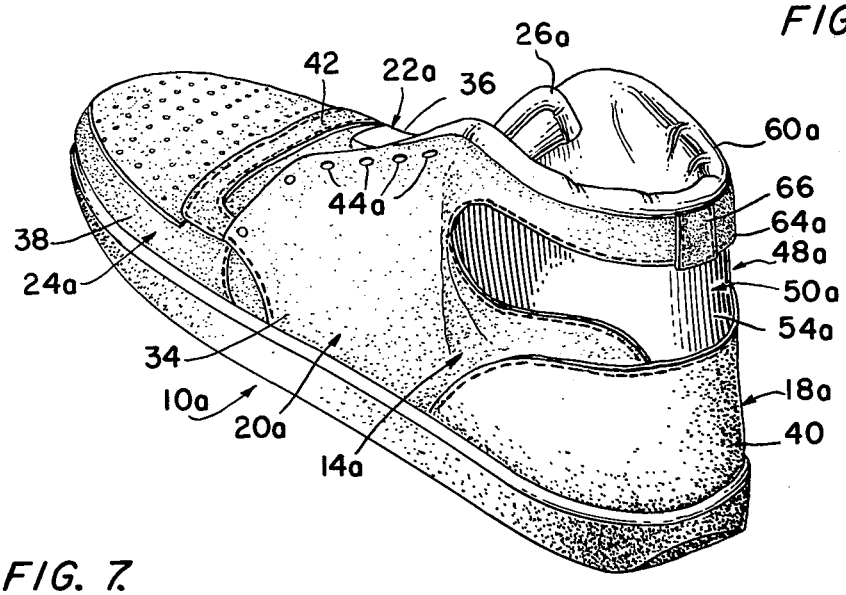
FIG. 6 is a view substantially similar to that of FIG. 1 illustrating a somewhat modified form of athletic shoe and collar.
Figure 7:
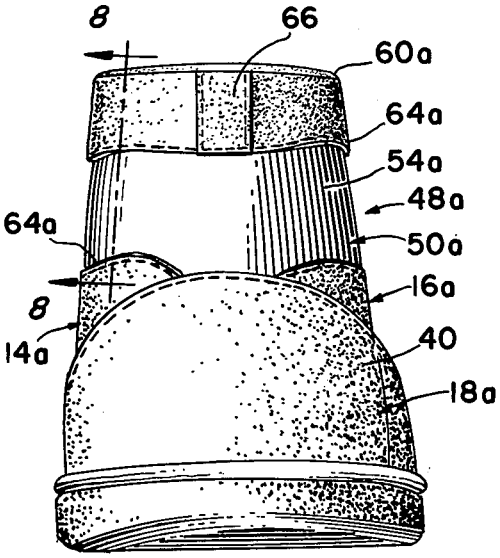
FIG. 7 is a view in elevation of the rear of the athletic shoe of FIG. 6.
Figure 8:
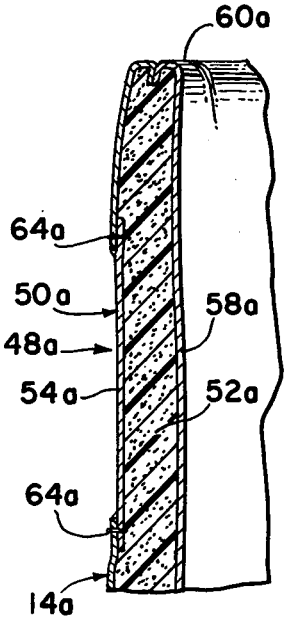
FIG. 8 is a view in section as seen along the line 8—8 in FIG. 7.

The insert 50 perhaps seen to best advantage in FIGS. 4 and 5 includes a layer 52 of foam and a layer 54 of sheet material. Layer 52 preferably is a hgh density foam, such as a polyurethane foam and the layer 54 may be vinyl to provide an outer surface cover. A second layer 56 of a similar foam material, a layer which may be considered to comprise a portion of insert 50, is located adjacent layer 52 toward the inner confines of the athletic shoe. In the form of athletic shoe illustrated in FIGS. 1–5, the layer 56 extends througout substantially the area of the quarter sections 14, 16, coextensive with layer 52 and extending toward the foot receiving opening. A second layer 58 of vinyl sheet material provides a backing for layer 56 within the athletic shoe. The foam layer 56 may be adhered to the vinyl sheet material layer 58 by an adhesive medium as may be conventionally used in the art.

Layer 58 of vinyl sheet material may be rolled outwardly, that is, toward the exterior of the athletic shoe to form a binding 60 along a length of the instep sections, for example, a length including two or three eyelets 44, to cover the edges of the upper region of the shoe upper and portions 34, 36. The binding, also, extends along the quarter sections 14, 16 of the shoe upper at the foot receiving opening. A binding 62, also surrounds the cutout 48 to secure the insert 50 to the shoe upper and in position within the cutout. Binding 62 may be formed of the same material as layer 58. Securement of both bindings may be provided by sewing the component parts together. The stitches are illustrated at 64.

The form of the invention of FIGS. 6–10 substantially duplicates the form of the invention previously described. In this form of the invention, however, the athletic shoe 10*a* includes a shoe upper of leather, similarly with a leather or leather-like material having a suede or simulated suede finish providing a surface covering over various portions of the shoe upper. In this connection, the quarter sections 14*a*, 16*a*, counter 18*a*, instep sections 20*a*, 22*a*, and toe section 24*a* include a covering, duplicating the form of athletic shoe of FIGS. 1–5, illustrated as portions 34, 36 . . . 42.

The leather surface of toe section 24*a* which is exposed is perforated to ventilate the interior of the athletic shoe 10*a*. The athletic shoe 10 of the form illustrated in FIGS. 1–5 is ventilated by passage of air through the uncovered portions of the shoe upper.

A cutout 48*a* (see FIGS. 6–8) is provided in the quarter sections 14*a*, 16*a* and similarly extends within the area over and around the ankle bones on the lateral and medial sides of the foot and around the rear of the foot over the Achilles tendon. An insert 50*a* closes the cutout.

In this form of the invention insert 50*a* comprises a layer 52*a* of foam and a layer 54*a* of sheet material providing a cover. Layers 52*a*, 54*a* are similar to the layers of the form of the invention previously discussed, except that layer 52*a* is of a thickness about twice the thickness of layer 52 and may be in the range of about one-quarter to three-eighths inch (6 to 10 mm).

A second layer 58*a* of vinyl sheet material covers the foam layer 52*a* within the athletic shoe. The foam layer may similarly be adhered to the sheet material layer, the latter of which is rolled outwardly of the athletic shoe to form a binding 60*a* along the length of the instep sections, for example, a length including two or three eyelets 44*a* to cover the edges of the upper region of the shoe upper and portions 34, 36. The insert 50*a* is stitched at 64*a* within cutout 48*a* and a backstay 66 is provided to secure the quarter sections 14*a*, 16*a* at the heel of the athletic shoe 10*a*.

The athletic shoes 10 and 10*a*, in other regards, are of similar construction.

The shoe upper of both forms of the inventions supports the foot and portions of the quarter sections 14, 16 (14*a*, 16*a*) above cutout 48 (48*a*) may be pulled snugly around the leg to provide firm securement of the athletic shoe 10 (10*a*) to the foot. In this connection, firmness of support derives from the construction of the shoe upper including either the laminas 28–32 and foam layer 56 or the leather of quarter sections 14*a*, 16*a* and foam layer 52*a*. The collar, also, provides support by virtue of a somewhat similar construction and, additionally, protects portions of the foot, particularly the ankle bones, therebelow because of its makeup and the material of which it is formed. Additionally, the collar provides a measure of pliability whereby the collar will bend or pleat easily over the region of the Achilles tendon to eliminate or substantially eliminate potential pressure points and resulting irritation.

We claim:

1. Footwear in the form of an athletic shoe including a sole assembly and an upper connected to said sole assembly, said upper having a pair of instep sections and quarter sections which extend over the foot above the region of the ankle, said athletic shoe characterized by a cut out area completely through the material of said quarter sections extending around the heel of the foot, over the Achilles tendon, toward and around the ankle bone on each side of the foot, and a closure for said cut out area, said closure comprising a collar of cushioning material which embraces, supports and protects the ankle bone as well as to provide a measure of pliability greater than that of the material within the surrounding portions of said upper to substantially eliminate any potential pressure points within said cut out area.

2. The footwear of claim 1 wherein said collar is a laminated construction including a high density foam material lamina and an outer cover lamina.

3. The footwear of claim 2 wherein said foam material lamina is a high density polyurethane foam of about one-quarter inch thickness and said outer cover lamina is vinyl sheet.

4. The footwear of claim 2 further including a layer of facing material comprising an inner lamina, said facing material secured to the inner surface at least of said quarter sections.

5. The footwear of claim 3 wherein said foam material lamina extends substantially within the quarter portions upper region.

6. The footwear of claim 5 including a plurality of eyelets extending along confronting edges of said instep sections adapted to receive a lace for securing said footwear in use, and wherein said foam material lamina cushions and supports the lower leg above the ankles.

7. The footwear of claim 1 wherein said quarter sections include an outer mesh material.

8. The footwear of claim 1 wherein said quarter sections are leather and said collar secured to said quarter sections at said cut out area.

9. Footwear in the form of an athletic shoe including a sole assembly and an upper connected to said sole assembly, said upper having a pair of instep sections and quarter sections including an outer mesh material which extend above the region of the ankle, said athletic shoe characterized by a cut out area in said quarter sections extending around the heel of the foot, over the Achilles tendon, toward and around bone on each side of the foot, and a closure for said cut out area, said closure comprising a collar of cushioning material which embraces, supports and protects the ankle bones as well as to provide a measure of pliability greater than that of surrounding portions of said upper to substantially eliminate any potential pressure points within said cut out area, and a binding around said mesh material at said cut out area securing both said mesh material and said collar to said cut out area.

* * * * *

UNITED STATES PATENT AND TRADEMARK OFFICE

CERTIFICATE OF CORRECTION

PATENT NO. : 4,451,996

DATED : June 5, 1984

INVENTOR(S) : Edward J. Norton, Paul Oparowski and Alphonse L. Belavitch

It is certified that error appears in the above-identified patent and that said Letters Patent is hereby corrected as shown below:

Column 3, line 5, after "and" insert --their--.

Column 6, line 8, after "around" insert --the ankle--.

Signed and Sealed this

*Twenty-third* Day of *April 1985*

[SEAL]

*Attest:*

DONALD J. QUIGG

*Attesting Officer*

*Acting Commissioner of Patents and Trademarks*

REEXAMINATION CERTIFICATE (739th)

United States Patent [19] [11] B1 4,451,996

Norton et al. [45] Certificate Issued Aug. 4, 1987

[54] ATHLETIC SHOE WITH COLLAR

[75] Inventors: Edward J. Norton, Kingston; Paul Oparowski, Derry; Alphonse L. Belavitch, Salem, all of N.H.

[73] Assignee: New Balance Athletic Shoe, Inc., Boston, Mass.

Reexamination Request:
No. 90/000,689, Dec. 18, 1984

Reexamination Certificate for:

| | |
|---|---|
| Patent No.: | **4,451,996** |
| Issued: | **Jun. 5, 1984** |
| Appl. No.: | **360,663** |
| Filed: | **Mar. 22, 1982** |

Certificate of Correction issued Apr. 23, 1985.

[51] Int. Cl.[4] ..... A43B 5/00; A43B 19/00
[52] U.S. Cl. ..... 36/129; 36/71
[58] Field of Search ..... 36/68, 69, 89, 129, 36/71, 45; 38/114, 89, 129

[56] References Cited

U.S. PATENT DOCUMENTS

| | | | |
|---|---|---|---|
| 190,753 | 5/1877 | Greenwood | 36/47 |
| 387,119 | 7/1888 | Stevens | 3/89 |
| 487,492 | 12/1892 | Pugsley | 2/22 X |
| 746,338 | 12/1903 | Keen | 36/89 X |
| 757,816 | 4/1904 | Krieger | 36/89 |
| 1,472,415 | 10/1923 | Haggerty | 36/89 |
| 1,581,783 | 4/1926 | Bullock | 36/89 |
| 1,610,700 | 12/1926 | Morton | 36/89 |
| 2,302,694 | 11/1942 | Jennings | 36/89 |
| 2,444,428 | 7/1948 | Carrier | 36/89 X |
| 2,918,734 | 12/1959 | Hyde | 36/89 |
| 2,942,359 | 6/1960 | Bushway et al. | 36/89 |
| 2,972,822 | 2/1961 | Tanner | 36/89 |
| 3,237,319 | 3/1966 | Hanson | 36/89 X |
| 3,535,800 | 10/1970 | Stohr | 36/120 |
| 3,537,716 | 11/1970 | Norgiel | 36/89 X |
| 3,659,361 | 5/1972 | White | 36/89 |
| 4,051,613 | 10/1977 | Collins | 36/114 |
| 4,222,183 | 9/1980 | Haddox | 36/114 |
| 4,316,335 | 2/1982 | Giese et al. | 36/129 |

FOREIGN PATENT DOCUMENTS

| | | | |
|---|---|---|---|
| 2162456 | 6/1973 | Fed. Rep. of Germany . | |
| 2606800 | 8/1977 | Fed. Rep. of Germany | 36/89 |
| 2068311 | 8/1971 | France | 36/89 |
| 12995 | of 1884 | United Kingdom . | |
| 16280 | of 1893 | United Kingdom . | |

*Primary Examiner*—Louis K. Rimrodt

[57] ABSTRACT

An athletic shoe includes an outsole assembly and a shoe upper whose quarter sections extend above the ankles. A cut out area extends over one ankle, around the heel and over the ankle within the quarter sections, and a collar closes the cut out area. The collar includes a high density foam lamina to support and protect the ankles, and, because of its pliability, potential pressure points exerted on the foot with accompanying irritation are substantially eliminated.

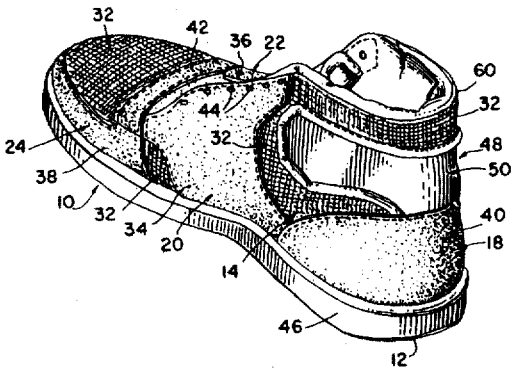

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 13–23:

The prior art is replete with disclosures of athletic shoes which include structure either within or supported by the athletic shoe for supporting the foot. Typically, the structure may embrace, support and protect the ankle bone on both the lateral and medial sides of the foot. Representative of prior art disclosures of athletic shoes are U.S. Pat. Nos. 1,610,700 to D. J. Morton; 2,942,359 to G. F. Bushway et al.; 3,237,319 to A. W. Hanson; 3,535,800 to R. Stohr; 3,537,716 to L. I. Norgiel; 3,659,361 to T. P. White, Sr.; and 4,222,183 to B. J. Haddox.

Column 2, lines 50–66:

The shoe upper (FIG. 3) comprises a mesh lamina 28, a lamina 30 of a foam material, and a fabric lamina 32 which may be of canvas or a canvas-like material. As may be seen in the [figures] *Figures,* and perhaps best seen in FIG. 3, the [mesh] *fabric* lamina *32* is visible from the exterior of the athletic shoe, while the foam material lamina is confined between that lamina *32* and the [fabric] *mesh* lamina *28* toward the interior of the athletic shoe. A leather or leather-like material having a suede or simulated suede finish provides a surface covering over portions of the shoe upper. The surface covering includes portions 34, 36 overlying the instep sections 20, 22, respectively, a portion 38 around the toe section 24, and a portion 40 over the counter 18. The surface covering also includes a portion 42 around the upper instep of the foot connecting with portion 38 on both the lateral and medial sides of the foot.

Column 3, lines 17–23:

A cutout 48 (see FIGS. 1–3) is provided in the quarter sections 14, 16. The cutout extends from within the area over and around the ankle bones on the lateral and medial sides of the foot and around the rear of the foot over the Achilles tendon. An insert 50 *which may be considered a collar* closes the cutout and, as will be discussed, provides embracing support and protection for the ankle bones, as well as the heel in the region of the Achilles tendon.

Column 3, lines 24–41:

The insert 50 perhaps seen to best advantage in FIGS. 4 and 5 includes a layer 52 of foam and a layer 54 of sheet material. Layer 52 preferably is a [hgh] *high* density foam, such as a polyurethane foam and the layer 54 may be vinyl to provide an outer surface cover. A second layer 56 of a similar foam material, a layer which may be considered to comprise a portion of insert 50, is located adjacent layer 52 toward the inner confines of the athletic shoe. In the form of athletic shoe illustrated in FIGS. 1–5, the layer 56 extends [througout] *throughout* substantially the area of the quarter sections 14, 16, [coextensive with] *juxtaposed the* layer 52 and [extending] *extends* toward the foot receiving opening. A second layer 58 of vinyl sheet material provides a backing for layer 56 within the athletic shoe. The foam layer 56 may be adhered to the vinyl sheet material layer 58 by an adhesive medium as may be conventionally used in the art.

Column 3, lines 42–54:

Layer 58 of vinyl sheet material may be rolled outwardly, that is, toward the exterior of the athletic shoe to form a binding 60 along a length of the instep sections, for example, a length including two or three eyelets 44, to cover the edges of the upper region of the shoe upper and portions 34, 36. The binding, also, extends along the quarter sections 14, 16 *at the top* of the shoe upper [at], *substantially surrounding* the foot receiving opening. *The cut out area within the quarter sections of the shoe upper is located below the binding 60 and below a portion of the quarter sections extending around the heel connecting with the instep sections at the foot receiving opening (see FIG. 1).* A binding 62, also surrounds the cutout 48 to secure the insert 50 to the shoe upper and in position within the cutout. Binding 62 may be formed of the same material as layer 58. Securement of both bindings may be provided by sewing the component parts together. The stitches are illustrated at 64.

Column 4, lines 3–8:

A cutout 48a (see FIGS. 6–8) is provided in the quarter sections 14a, 16a and similarly extends within the area over and around the ankle bones on the lateral and medial sides of the foot and around the rear of the foot over the Achilles tendon. An insert 50a *which may be considered a collar* closes the cutout.

Column 4, lines 16–26:

A second layer 58a of vinyl sheet material covers the foam layer 52a within the athletic shoe. The foam layer may similarly be adhered to the sheet material layer, the latter of which is rolled outwardly of the athletic shoe to form a binding 60a along the length of the instep sections, for example, a length including two or three eyelets 44a to cover the edges of the upper region of the shoe upper and portions 34, 36. *The binding, also, extends along the quarter sections 14a, 16a at the top of the shoe upper, substantially surrounding the foot receiving opening.* The insert 50a is stitched at 64a within cutout 48a and a backstay 66 is provided to secure the quarter sections 14a, 16a at the heel of the athletic shoe 10a. *The cutout 48a within the quarter sections of the shoe upper, similar to the cutout 48 of athletic shoe 10, is located below binding 60a and below a portion of the quarter sections extending around the heel connecting with the instep sections at the foot receiving opening (see FIG. 6).*

AS A RESULT OF REEXAMINATION, IT HAS BEEN DETERMINED THAT:

Claims 1–5 and 7–9 are cancelled.

Claim 6 is determined to be patentable as amended.

New claims 10 and 11 are added and determined to be patentable.

6. The footwear of claim [5] *11* including a plurality of eyelets extending along confronting edges of said instep sections adapted to receive a lace for securing said footwear in use, and wherein said foam material lamina cushions and supports the lower leg above the ankles.

*10. Footwear in the form of an athletic shoe including a sole assembly and an upper connected to said sole assembly, said upper having a pair of instep sections and quarter sections which extend over the foot above the region of the ankle, said athletic shoe characterized by a cut out area within said upper, below a binding at the top of the quarter sections of the shoe and completely through the material of said quarter sections, said cut out area extending over the Achilles tendon and toward and around the ankle bone on each side of the foot, a closure for said cut out area, said closure comprising a collar of cushioning material which embraces, supports and protects the ankle bones as well as to provide a measure of pliability greater than that of the material within the portion of said upper which completely surrounds the cut out area to substantially eliminate any potential pressure points within said cut out area, said collar being of laminated construction including a high density foam material lamina and an outer cover lamina, and a layer of facing material comprising an inner lamina, said facing material secured to the inner surface at least of said quarter sections.*

*11. Footwear in the form of an athletic shoe including a sole assembly and an upper connected to said sole assembly, said upper having a pair of instep sections and quarter sections which extend over the foot above the region of the ankle, said athletic shoe characterized by a cut out area within said upper, below a binding at the top of the quarter sections of the shoe and completely through the material of said quarter sections, said cut out area extending over the Achilles tendon and toward and around the ankle bone on each side of the foot, a closure for said cut out area, said closure comprising a collar of cushioning material which embraces, supports and protects the ankle bones as well as to provide a measure of pliability greater than that of the material within the portion of said upper which completely surrounds the cut out area to substantially eliminate any potential pressure points within said cut out area, said collar being of laminated construction including a high density polyurethane foam material lamina of about one-quarter inch thickness, and an outer cover lamina of vinyl sheet, and wherein said high density polyurethane foam material lamina extends substantially within the quarter portions upper region.*

* * * * *